United States Patent [19]

Hawkes

[11] Patent Number: 4,759,207

[45] Date of Patent: Jul. 26, 1988

[54] TRANSFER MEANS FOR A CONTINUOUS ELONGATE PRODUCT

[75] Inventor: Daniel J. Hawkes, Ramsgate, England

[73] Assignee: Babcock Wire Equipment Limited, Ashford, England

[21] Appl. No.: 913,388

[22] Filed: Sep. 30, 1986

[30] Foreign Application Priority Data

Sep. 30, 1985 [GB] United Kingdom ..... 8524081

[51] Int. Cl.[4] ..... B21C 35/02

[52] U.S. Cl. ..... 72/257; 72/378

[58] Field of Search ..... 72/257, 378; 226/42, 226/44

[56] References Cited

U.S. PATENT DOCUMENTS

| | | | |
|---|---|---|---|
| 3,586,222 | 6/1971 | Rosen | 226/42 |
| 3,667,664 | 6/1972 | Schroeder | 226/42 |
| 3,863,481 | 2/1975 | Dibrell | 72/257 |

*Primary Examiner*—Lowell A. Larson

*Attorney, Agent, or Firm*—Solon B. Kemon

[57] ABSTRACT

Transfer means for transferring a continuous elongate product, such as wire, bar or tubular products associated with a continuous extrusion machine, between two stations in the production line. Axial tensioning means 8, 10 each consisting of a pair of resiliently tyred wheels 12, 14 positioned to grip the elongate product 2 and driven by a low inertia, electric, motor induce an axial tension in the elongate product 2. The elongate product forms a curve 20 of catenary form between the axial tensioning means 8, 10. A control signal indicative of the gravitational deflection of the curve is derived from an ultra-light dancer arm 22, or an optical or ultra-sonic sensor, and is utilized in combination with a signal derived from product speed sensor means 24 to control the speed of the low inertia, electric, motors and thus the tension in the elongate product. By providing the axial tensioning means 8, 10 a degree of transient tolerance is obtained between, for example, extrusion speed and spooling speed thereby avoiding axial and radial deformation of the elongate product during transfer along the product line.

5 Claims, 1 Drawing Sheet

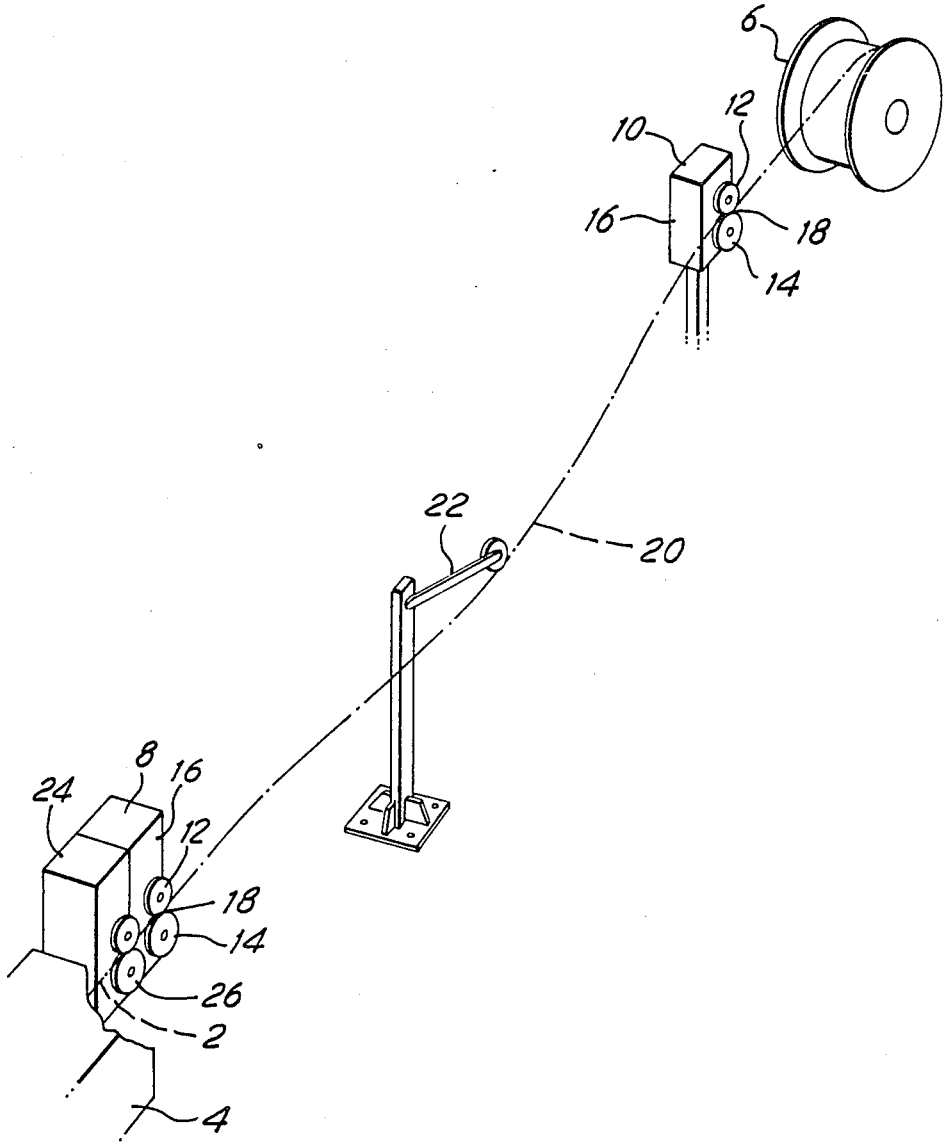
6
12
10
16
18
14
22
20
8
16
24
12
18
14
26
2
4

TRANSFER MEANS FOR A CONTINUOUS ELONGATE PRODUCT

DESCRIPTION

This invention relates to transfer means for transferring a continuous elongate product between two stations, such as a pay-off reel and forming apparatus, or forming apparatus and a take-up spool or cutting station. More particularly, the invention relates to apparatus in which output from a continuous extrusion machine is wound onto a take-up spool. In addition, the continuous extrusion machine may be fed with feedstock or core material from pay-off reel.

Hitherto the output from such apparatus has been fed over a pair of spaced sets of rollers, one set adjacent the apparatus producing the continuous elongate product and the other set adjacent the take-up spool and permitted to hang as a curved portion approximating to a catenary curve therebetween, any transient slight mismatch between speeds of movement over the sets of rollers being absorbed by increasing or decreasing of the radii of curvature of the curved portion. A dancer arm bears on the curved portion partially to tension the curve and to sense the position thereof and adjust the speed of the take-up spool appropriately.

According to the present invention there is provided transfer means for transferring a continuous elongate product between two stations in which axial tensioning means adapted to exert traction on the continuous elongate product are positioned intermediate the stations to isolate the tension in the product adjacent one of the stations from the tension in the product adjacent the other of the stations, the tractive force being regulated in accordance with the speed of transfer of the product.

The invention will now be described, by way of example, with reference to the accompanying, partly diagrammatic, isometric drawing of a wire feed transfer means forming part of a product line.

As shown in the drawing, wire 2 is transferred from an output end 4 of a forming machine (not shown) to a take-up reel 6 through first and second axial tensioning means 8, 10 of modular form. Each axial tensioning means consists of a pair of wheels 12, 14 mounted in a frame 16 and positioned to grip wire 2 passing through the nip 18 between the wheels. Each wheel of the pair of wheels is driven by a low inertia, printed circuit, motor (not shown) and is provided with a soft, resilient, tire (not shown). One of the wheels of each pair of wheels and the respective associated motor are mounted on a sub-frame (not shown) moveable by means of a threaded adjuster on the frame to vary the spacing betwen the wheels of the pair of wheels, and thus the nip.

The first and second axial tensioning means 8, 10 are positioned respectively at the entry and exist extremes of a portion of the product line in which a curved portion approximating to a catenary curve 20 is allowed to form. The vertical position of the curve is sensed by a dancer arm 22, the mass of which is reduced to a minimum such that a minimum of loading is placed on the curved portion. Alternatively, an ultra-sonic or optical sensor is utilised to determine the vertical position of the curve. In each case, a transducer (not shown) is arranged to produce a signal indicative of the position of the curve, and hence the tension in the wire.

Product speed sensing means 24 are bolted to the upstream face of the frame 16 of the first axial tensioning means 8 and include a pulley 26 positioned to be engaged by the wire product and driving a transducer (not shown) giving a signal indicative of the running speed of the wire product in the product line, from which is obtainable the length of the product, through integrating the speed sensing means signal output in relation to time.

The control circuitry (not shown) includes a pair of motor speed signal amplifiers connected to receive signals from the respective drive motors of the pairs of wheels 8, 10 and to transmit amplified signals to a preferential amplifier which delivers a signal to a tension speed comparator and a speed error comparator, arranged in parallel. A digitally set, analogue tension reference signal is applied to the tension speed comparator and a digitally set, analogue overspeed signal together with an amplified wire product speed signal from the speed sensing means is applied to the speed error comparator. The tension speed comparator and the speed error comparator are connected to deliver signals to a current limiter arranged to compare the two signals and select that indicating the least amount of error. The current error signal emanating from the current limiter is passed through a current error amplifier to a comparator arranged to generate a square wave pulsed signal utilising input from a triangle wave generator. The square wave pulsed signal is fed to a switch driver making appropriate adjustments to a power switch controlling power input to the drive motors. A feedback circuit is connected between the power switch and the current error amplifier to provide a control loop.

The signal emanating from the speed sensing means 24 is fed together with a signal emanating from the transducer associated with the dancer arm 22 or other curve position sensors to an electronic digital control system which is arranged to originate signals compensated for windage and frictional losses to govern the speed of the driven wheels of the axial tensioning means so that a predetermined and constant tension is produced in the wire product at all speeds. Control is effected through cascaded speed and electrical current loops such that if slipage occurs between the wire product and the driven wheels, the increase in rotational speed of the driven wheels is restrained, thereby encouraging re-establishment of positive driving traction. Control of the speed of progress of the wire product at the station subsequent to the second axial tensioning means is also effected by the electronic digital control system.

The axial tensioning means 8, 10 are of modular form permitting ganging together of two of more in series to achieve better traction in order to apply greater tension or to handle delicate products, such as thin walled tube, where the allowable pressure which may be applied is thereby subject to an upper limit. Alternatively, a ganged pair of wheels may have belts substituted for the resilient tires to form a belt drive having a lower inertia.

In an alternative arrangement, where a caterpillar belt type haul-off unit is employed, axial tensioning means are positioned upstream and downstream of the haul-off unit to regulate the tension in the product on entry to and exit from the unit.

In one installation, a continuous extrusion machine (not shown), such as that described in GB Patent No. 1 370 894, in which feedstock is introduced into a circumferential groove in a rotating wheel and is extruded as wire from an orifice in arcuate tooling extending into the groove adjacent an abutment positioned in the groove is arranged for the wire to be wound on to the take-up spool 6. Wire output from the continuous extrusion machine is passed through a cooler and successively over the pulley 26 of the speed sensing means 24 and the first and second axial tensioning means 8, 10 to the powered take-up spool 6. The wire 2 falls as a curve approximating to a natural catenary 20 curve between the first and second axial tensioning means and the ultralight dancer arm 22 is positioned adjacent the mid-point of the curve to sense the vertical position thereof.

Transducers respectively coupled to the speed sensing means 24 and to the dancer arm 22 originate signals which are fed to an electronic digital control system which in turn produces signals for controlling the speeds respectively of the first and the second axial tensioning means 8, 10 and of the take-up spool drive.

In operation, to start-up the product line, extrusion is commenced and the output wire fed through the cooler and over the pulley of the speed sensing means 24 and between the nip 18 of the first axial tensioning means 8, the drive of which is energised. Upon traction being applied by the first axial tensioning means to the wire, any risk of the wire fouling the cooler or the extruder during ensuing stages of start-up is largely avoided. The wire from the first axial tensioning means 8 is then carried in a curve under the dancer arm 22 to the nip 18 of the second axial tensioning means 10—which is positioned in the same horizontal plane as the first axial tensioning means—and the drive to which is then energised. Finally the wire is connected to the take-up spool 6 and the spool drive energised. The respective speeds of the continuous extrusion machine, the first and second axial tensioning means and the spool drive are then adjusted to give the required operating conditions and the automatic control system activated. The curve of the curved portion of wire between the first and second axial tensioning means is arranged to be of such radii as to provide a degree of transient tolerance between the speed at which wire is extruded and the speed at which the wire is spooled and thereby avoid axial deformation of the wire whilst not being such as to lead to radial deformation of the wire due to bend radii being too small. Since the curved portion of wire is allowed to form a curve approximating to a catenary, the mass of the dancer arm being minimal, the dynamic variations in the form of accelerations and decelerations, that is, the inertia of the arrangement, are reduced to a minimum, thereby reducing tension transients to a minimum. By appropriate positioning of the first and second axial tensioning means it can be ensured that the elastic limit of the wire material is not exceeded in the bends. In a situation where this is not achievable it is necessary to limit the plastic deformation to an amount which permits subsequent straightening without significantly affecting the wire.

By providing the first axial tensioning means 8, the extrusion die orifice is effectively isolated from the curved portion and an accurate, constant, tension may be maintained at the die, thereby assisting in maintaining extrusion quality by compensating for small inequalities in die flow.

By providing the second axial tensioning means 10 the curved portion is isolated from the take-up spool 6 thereby permitting compensation of the lay borne transients arising from the layered surface of wound wire not being even without transmitting the transient variation back down the wire and thereby avoiding the production of minor discontinuities in the wire from, for example, compensatory movement of the dancer arm.

With the first and second axial tensioning means controlling the extrudate tension and the spooling tension a more precise control is applied to the arrangement compared with previous arrangements in which movement of the dancer arm is utilised directly to control the spooler speed and speed variations are absorbed solely in the curved portion.

Since the curved portion approximates more closely to the natural catenary in the present arrangement as compared with previous arrangements in which the dancer arm is required to place a loading on the curved portion, the curved portion is inherently more stable. As a result, higher loop gains may be utilised in the electronic control system, again leading to a more positive control of the arrangement.

It will be appreciated that should a failure occur in the take-up spool drive, the axial tensioning means reduce the risk of a build-up of wire occuring and facilitate re-starting of the line.

It will also be appreciated that the axial tensioning means may be utilised in other arrangements (not shown) involving transfer of a continuous element. Thus an axial tensioning means may be utilised to feed the continuous element as feedstock or as a core element for co-axial continuous extrusion from a pay-off spool. Such feed may pass through a cleaner and induction heater. Additionally an axial tensioning means may be utilised intermediate a continuous extrusion machine and a drawing-down die through which the product is hauled by means of a capstan before passing over a set of rollers arranged to absorb any transient shock loading in the arrangement prior to winding on a take-up spool.

Where the continuous extrusion machine is utilised to produce a metallic sheathing around a core of platics material a shallow catenary curve 20 is employed to facilitate creep of the plastics material core within the sheathing during the forming process.

Arrays of guide rollers may be positioned at the end regions of the catenary curve 20 to limit curvature at those regions.

As a further alternative (not shown), particularly in an arrangement in which thin walled tubing is extruded, instead of a take-up spool, the second axial tensioning means in the previously described installation may be arranged to deliver extrudate as a straight product to cutting means to produce cut straight lengths of the product. Where the extrudate is of relatively small section, a rotating cutter and magazine may be utilised. The magazine takes the form of a three lobed rotor housed within a horizontally extending cylindrical sleeve open over a lower 120° of arc to register with the lobes on the rotor. A two part blade is mounted at the entry to the magazine, a first part being secured to the rotor and having suitable apertures aligned with interstices intermediate the lobes and the second part being secured to the cylinder with a single aperture in alignment with the interstices intermediate the lobes when in an upper segment of the sleeve. In operation, indexing means position the rotor with one of the apertures in the first blade registering with the aperture in the second blade. Extrudate is fed through the apertures into the corresponding interstice for a predetermined length, whereupon a control sequence is initiated to rotate the rotor and first blade, thereby severing the extrudate and registering the next aperture in the first blade with the single aperture in the second fixed blade to permit extrudate to feed into the adjoining interstice. The cut length of extrudate then falls from the open portion of the sleeve to suitable collecting means. Whilst the cutting and indexing step interrupts the feeding of the extrudate, where the cutting speed is fast in relation to the extrusion speed the interruption is readily absorbed in the curved portion of the line without developing damaging transients.

Alternatively, a flying saw arrangement (not shown) may be utilised in which the saw is accelerated to approximately extrudate speed before clamping to the extrudate and cutting to length. Any variation between the speed of the extrudate and the saw at the instant of clamping is absorbed in the curved portion of the line to avoid damaging transient shock loads.

As a further alternative (not shown), pullers may be provided in combination with the flying saw when relatively large section extrudate is involved. Since the tension produced by the pullers can be controlled closely, an almost flat curved portion 22 can be utilised since the transient loading on change-over of pullers is relatively small, thereby facilitating the extrusion of sections which would be adversely affected by imposition of undue curvature.

With heavier sections, the curved portion may be dispensed with, transient loading being absorbed in the axial elasticity of the extrudate. In one arrangement a reciprocable cradle is acceleratable to match the extrudate speed and carries the cutter mechanism. By controlling the cradle speed to keep the cutter mechanism central in the cradle a defined tension is generated utilising a pneumatic cylinder actuated puller. This serves to reduce significantly the rigidity coupled inertia of the assembly.

I claim:

1. An apparatus for transferring an elongate material from a continuous extrusion machine to an operating station horizontally spaced a distance therefrom, comprising:

at least first and second axial tensioning means;

said at least first and second axial tensioning means being positioned intermediate the continuous extrusion machine and the operating station for isolating the tension in the elongate material adjacent the continuous extrusion machine from the tension in the elongate material adjacent the operating station;

said at least first and second axial tensioning means including conveying means in abutting contact with the elongate material for exerting a force thereon;

drive means operably associated with said conveying means of said at least first and second axial tensioning means;

means for sensing the gravitational deflection of the elongate material between said first and second axial tensioning means;

means for generating a first signal for indicating the gravitational deflection of the elongate material;

means for sensing the speed of the elongate material; means for generating a second signal indicating the speed of the elongate material;

means for comparing said first and second signals to a predetermined value; and means for regulating said drive means operably asssociated with said conveying means of said at least first and second axial tensioning means for ensuring that said first and second signals remain substantially equal to said predetermined value for maintaing a substantially constant tension at an extrusion die orfice of the continuous extrusion machine.

2. An apparatus as in claim 1, wherein:

said drive means includes at least one low inertia electric motor.

3. An apparatus as in claim 1, wherein:

said conveying means include at least one pair of opposed wheels positioned in abutting contact with the elongate material; and at least one of said wheels is drivingly connected to said drive means.

4. An apparatus as in claim 1, wherein:

said first axial tensioning means is positioned adjacent the continuous extrusion machine;

said speed sensing means is positioned intermediate said first axial tensioning means and the continuous extrusion machine; and said speed sensing means includes at least one wheel in abutting contact with said elongate material.

5. An apparatus for transferring an elongate material from a continuous extrusion machine to an operating station spaced horizontally a distance therefrom, comprising:

at least first and second axial tensioning means;

said at least first and second axial tensioning means being positioned intermediate the continuous extrusion machine and the operating staion for isolating the tension in the elongate material adjacent the continuous extrusion machine from the tension in the elongate material adjacent the operating station;

said at least first and second axial tensioning means including conveying means in abutting contact with the elongate material for exerting a force thereon;

said conveying means including at least one pair of opposed wheels operably associated with each of said at least first and second axial tensioning means, said opposed wheels being positioned in abutting contact with the elongate material;

drive means operably associated with at least one of said opposed wheels of said conveying means of said at least first and second axial tensioning means;

said drive means includes at least one low inertia electric motor;

means for sensing the gravitational deflection of the elongate material between said first and second axial tensioning means;

means for generating a first signal for indicating the gravitational daflection of the elongate material;

means for sensing the speed of the elongate material;

means for generating a second signal for indicating the speed of the elongate material;

means for comparing said first and second signals to a predetermined value;

means for regulating said electric motor for ensuring that said first and second signals remain substantially equal to said predetermined value for maintaining a substantially constant tension at an extrusion die orfice of the continuous extrusion machine.

* * * * *